United States Patent [19]

Golden

[11] 3,992,013

[45] Nov. 16, 1976

[54] GOLF CLUB SWING TRAINING METHOD

[76] Inventor: Steven T. Golden, 822 Teague Drive, Santa Paula, Calif. 93060

[22] Filed: June 20, 1975

[21] Appl. No.: 588,601

[52] U.S. Cl. ..... 273/186 D; 273/194 A; 273/171; 273/172; 273/195 R

[51] Int. Cl.[2] ..... A63B 69/36

[58] Field of Search..... 273/186 A, 186 D, 183 A, 273/32 B, 181 K, 194 A

[56] References Cited

UNITED STATES PATENTS

| | | | |
|---|---|---|---|
| 1,637,339 | 8/1927 | Glennon et al. | 273/183 A X |
| 2,090,348 | 8/1937 | Ferry | 273/186 D |
| 2,681,225 | 6/1954 | De Vries | 273/194 A |
| 3,649,028 | 3/1972 | Worrell | 273/183 A |

*Primary Examiner*—George J. Marlo
*Attorney, Agent, or Firm*—Poms, Smith, Lande & Glenny

[57] ABSTRACT

Method and device is provided for recording the swing of a golf club over a mat and permitting the analysis of the depth of the swing, the arc of the swing and the angle of the face of the golf club head when it contacts the mat. A resilient mat is covered with a thin film of chalk dust and a golf club having an attachment secured to the golf club head capable of dispersing the dust on the mat when it contacts the mat. The dust is dispersed in a pattern on the mat, which due to the attachment, permits analysis to determine the foregoing. The mat may also be provided with indicia related to a golf ball and the equivalence of making a divot by the golfer may also be determined.

4 Claims, 22 Drawing Figures

GOLF CLUB SWING TRAINING METHOD

BACKGROUND OF THE INVENTION

1. Field of the Invention

The invention relates to a golf swing training and recording device and method; and, more particularly, to means for analyzing the swing of a golfer.

2. Description of the Prior Art

Various training devices are known for analyzing the swing of a golfer. Certain of these devices require golf clubs and/or head of a specific type. Thus, they differ from the weight and feel of an equivalently rated golf club and thus are ineffective when the golfer attempts to put his use of such device into practice.

It has been suggested that three factors are critical in evaluating the correct swing of a golfer. First, a straight club face is required to hit a straight ball using all golf clubs. The horizontal arc of the golfer's swing over the target is a second critical factor. His vertical arc or depth of swing is the third critical factor. No element of a vertical arc would be found in a perfect horizontal swing and vice versa. None of the prior art devices and methods permit the evaluation of all of these critical factors. All three factors are necessary to correctly evaluate and analyze the golfer's swing, in addition to enabling him to use the same natural swing weight and force he would use in normal play.

In addition, certain prior art devices and methods do not permit an incremental and cumulative recording of the golfer's progress, which can be easily removed when desired. It may be necessary for a beginning golfer to have an incremental and cumulative recording of his progress to correct his swing as he goes along by comparing it to prior swings. Many such swings may be required to produce a correct swing. Finally, such a device should be durable enough to permit the recording of many such swings, yet be instantly reusable for the next set of swings.

SUMMARY OF THE INVENTION

It is an object of this invention to provide a golf swing training and recording device which permits the analyses of the depth of swing, the arc of swing and the club face angle of a golfer.

It is another object of this invention to carry out the foregoing object without changing the weight of an equivalent conventionally rated club enabling a golfer to use the normal clubs he plays with on the course in home practice to perfect his swing.

It is still another object of this invention to provide means for carrying out the first-mentioned object of this invention using conventional golf clubs without appreciably affecting the golf club head weight thereof.

It is an even further object of this invention to provide a golf swing training and recording device which records the equivalence of the user's making of a divot.

It is still another object of this invention to provide a golf swing training and recording device which is durable, long lasting, economical and reusable.

It is another object of this invention to provide a golf swing training and recording device which can record a sequential number of golf swings permitting comparison analysis.

It is a further object of this invention to provide means which shows the practicing golfer at a glance whether his swing and club face angle were correct when he made his last swing, and if not, then allow him, without any distracting movements, to incrementally correct his swing by further minor adjustment on each succeeding swing until the proper recording means have been made. When he has learned to make the proper recording means every time he swings at the practice mat, he can then hit a straight golf ball with certainty.

These and other objects are preferably accomplished by providing a method and device for recording the swing of a golf club over a mat and permitting the analysis of the depth of the swing, the arc of the swing and the angle of the face of the golf club head when it contacts the mat. A resilient mat is covered with a thin film of chalk dust and a golf club having an attachment secured to the golf club head capable of dispersing the dust on the mat when it contacts the mat. The dust is dispersed in a pattern on the mat, which, due to the attachment, permits analysis to determine the foregoing. The mat may also be provided with indicia related to a golf ball and the equivalence of making a divot by the golfer may also be determined.

DESCRIPTION OF THE PREFERRED EMBODIMENT

Figure 1:
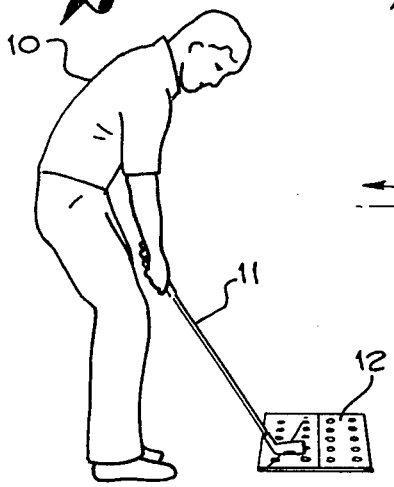
FIG. 1 is a perspective view of a golfer about to use the mat which forms a part of the device and method of my invention.

Referring now to FIG. 1 of the drawing, a golfer 10 is shown holding a golf club 11 in position over a mat 12.

Figure 2:
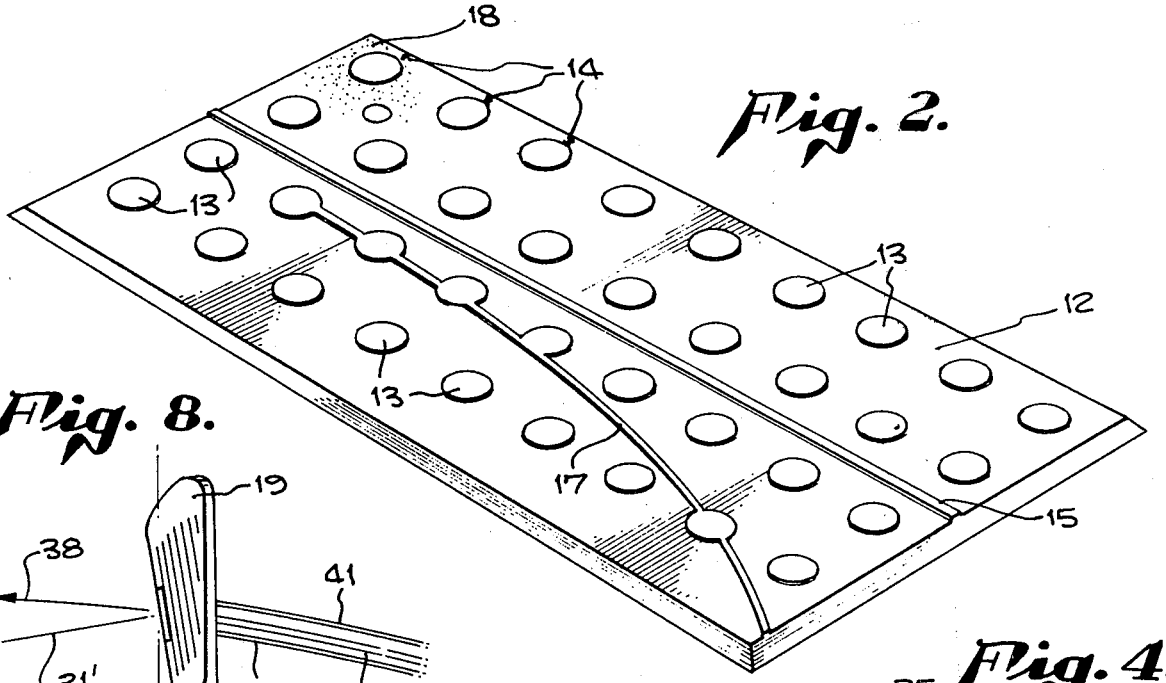
FIG. 2 is a perspective view of the mat of FIG. 1.

Mat 12 is shown more specifically in FIG. 2 and includes a plurality of spaced raised surfaces 13 of an outer diameter related to the outer diameter of a conventional golf ball. These surfaces 13 are only slightly raised, such as three-thousandths of an inch, for reasons to be discussed shortly. The underside of mat 12 may be suctioned, if desired, to provide a better gripping surface. Indicia 14 may be provided (not all surfaces 13 being numbered for convenience of illustration) to indicate progressive golf strokes. Center line 15 may be used to align mat 12 with an imaginary green. Aperture 16 may be used to set a conventional rubber golf ball driving tee (not shown) therein so that mat 12 may be used as a driving mat. Line 17 may be used to indicate the grooved swing of a golfer.

As particularly contemplated by the invention, a relatively soft, friable dust-like dispersible means may be disposed on the upper surface of mat 12 which may be dispersed by contact of suitable means associated with club 11 as will be described. In the exemplary embodiment, such dispersible means may include chalk dust 18 of a contrasting color than mat 12 which may be spread in a thin film on all or a portion of the upper surface of mat 12, as, for example, surrounding surface 13 indicating the first hole or golf ball-indicating means numbered "One".

Figure 4:
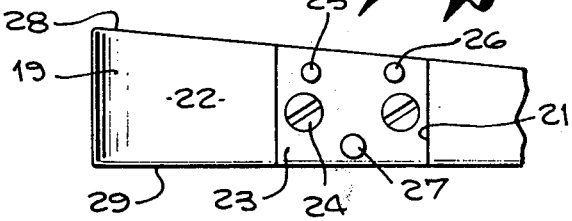
FIG. 4 is a view taken along the lines IV—IV of FIG. 3.
Figure 3:
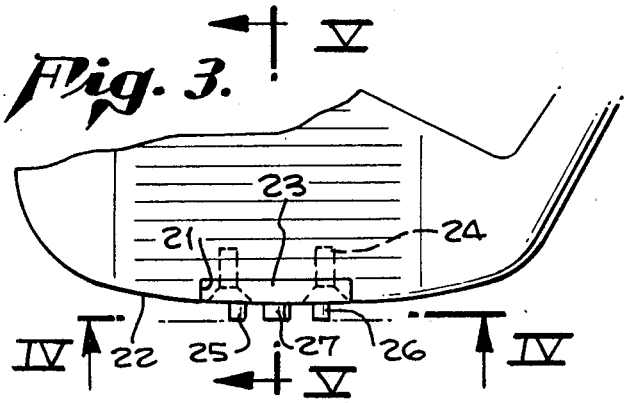
FIG. 3 is a vertical view of a portion of the head of a conventional golf club showing one type of attachment means in accordance with the invention.
Figure 5:
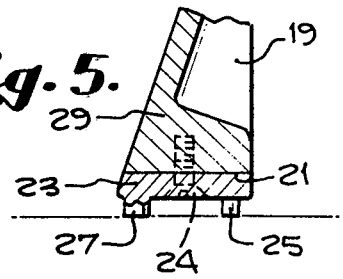
FIG. 5 is a view taken along the lines V—V of FIG. 3.

FIG. 3 illustrates the head 19 of a conventional golf club 20. It is to be understood that head 19 is also conventional but, in the exemplary embodiment of the invention, includes dispersing means for dispersing the chalk dust 18 on mat 12, as will be described, when head 19 is brought into contact therewith. In the exemplary embodiment of the invention, a groove or cavity 21 is formed on the undersurface 22 of head 19 and plate 23 is secured therein, as by screws 24 or the like. The dispersing means preferably includes, in this embodiment, three downwardly extending elements in the form of pegs 25 through 27. Screws 24 are countersunk so that they are flush with the bottom surface of plate 23. Pegs 25 and 26 are generally of the same diameter and linearly aligned with the planar face of rear wall 28 of head 19. Peg 27 may be slightly greater in overall diameter than pegs 25 and 26 and generally equally spaced from each peg 25, 26 as shown in FIG. 4. Thus, as particularly shown in FIG. 5, peg 27 is disposed adjacent the front face 29 of head 19.

Figure 6:
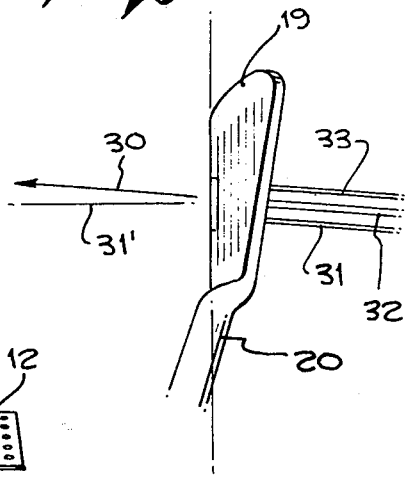
FIG. 6 illustrates recording means permitting one type of analysis made on the mat of FIG. 2 as the golf club head contacts the mat.

FIGS. 6 through 9 illustrate various recording means which may be recorded on mat 12 using head 19. As shown in FIG. 6, line 30 indicates the direction of the swing of head 19. Line 31′ may indicate the direction of an imaginary green and thus related to centerline 15 on mat 12. The chalk dust 18 on mat 12 is displaced by pegs 25 through 27 forming three arcuate lines 31 through 33. Since line 30 is a continuation of lines 31–33, and the spacing between each line 31–33 is even, a good swing is recorded on mat 12. The club face angle of head 19 at contact with mat 12 was good. Although lines 31 through 33 are not extended their full length in FIG. 6, their overall length would record the depth of swing. A slight slice would be indicated if line 32 were closer to line 33 than line 31 (the club face was thus slightly open at contact) and a slight hook would be indicated if line 32 were closer to line 31 than line 33 (indicating the club face closed slightly at contact).

Figure 7:
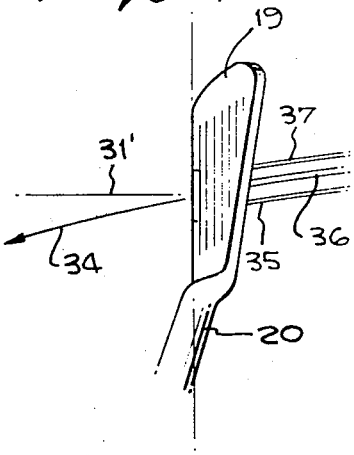
FIG. 7 illustrates recording means on the mat of FIG. 2 permitting another type of analysis.

FIG. 7 illustrates an appreciable slice recorded on mat 12 using head 19. Line 34 an extension of the arc of lines 35 through 37, indicates the arc of swing. The fact that the golfer sliced his club head 19 may readily be determined by the fact that he swung from outside in. The line of arc 34 is off appreciably from the center line. The spacing between lines 35 and 36 is substantially greater than the spacing between lines 36 and 37 indicating that he had an open club face with his slide. Again, the overall length of lines 35 through 37 would record the depth of swing.

Figure 8:
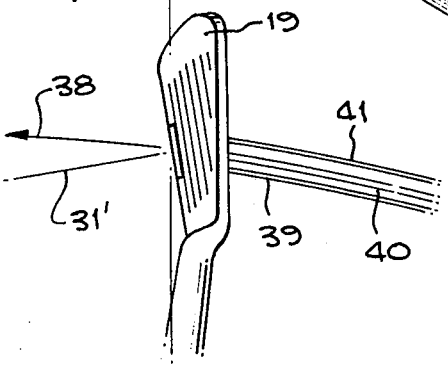
FIG. 8 illustrates yet a third type of recording means.

FIG. 8 records the fact that the golfer appreciably hooked his shot by swinging inside out. Line 38, again a continuation of lines 39 through 41, shows the arc of the swing and thus the hook and the overall length of lines 39–41 indicates the depth of his swing. The fact that the spacing between lines 39 and 40 is substantially less than the spacing between lines 40 and 41 records that the golfer had a closed club face when he hooked his shot.

Figure 9:
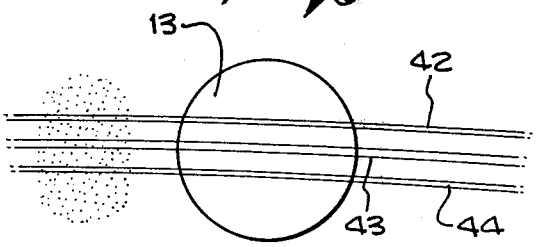
FIG. 9 illustrates a fourth type of recording means.

In FIG. 9, a divot is recorded since lines 42 through 44 terminate abruptly and are blurred. Thus, the effect of a golfer making a divot on mat 12 is also recorded.

In all of the foregoing, it is to be understood that lines 31–33, lines 35–37, lines 39–41, and lines 42–44 actually indicate chalk dust marks on mat 12 displaced by pegs 25 through 27. Also, peg 27, since it is greater in diameter than pegs 25 and 26, readily indicates the center line of the marks. Obviously, peg 27 may be of the same diameter. Further, it is to be understood that the golfer may sequentially move from one raised surface 13 to another on mat 12 leaving an incremental record of his progress. Chalk dust 18 may be easily removed from mat 12 by shaking and/or wiping it clean thus preparing for further recordings. Since surfaces 13 are slightly raised, no chalk dust collects on surface 13 which might be the case if only indicia or depressions were provided on mat 12.

Figure 10:
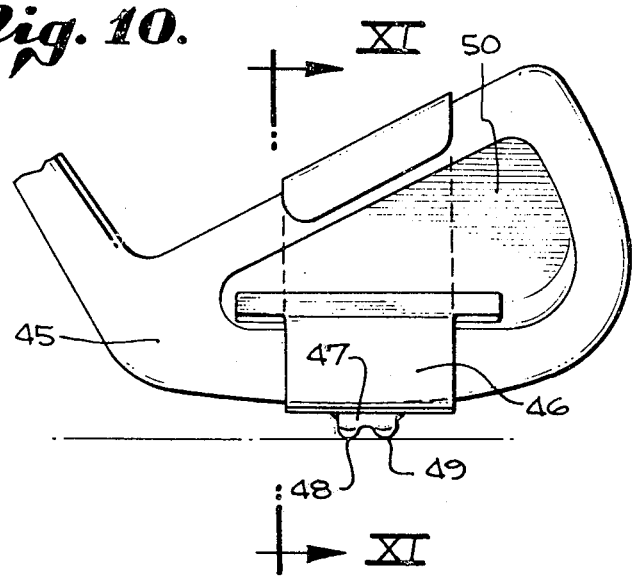
FIG. 10 illustrates a vertical view of another type of removable attachment means for a golf club head.
Figure 11:
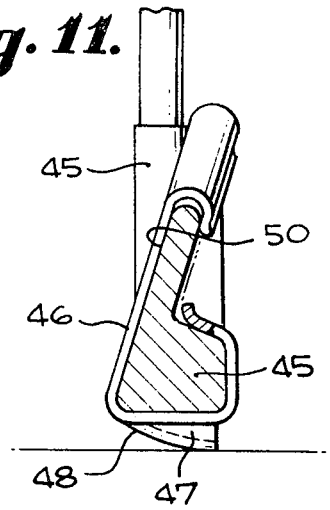
FIG. 11 is a partly sectional view taken along the lines XI—XI of FIG. 10.

Referring now to FIGS. 10 and 11, a second exemplary embodiment of the dust displacing or dispersing means is shown. As particularly contemplated in the present invention, a golf club head 45 is shown having the dust displacing means 46 removably secured thereto. Means 46 comprises a plate configured to snap-fit onto head 45 as shown and includes a downwardly extending portion 47 comprising a pair of longitudianlly extending tracks spaced 48, 49. These tracks 48, 49 extend generally normal to the face 50 of head 45.

Figure 12:
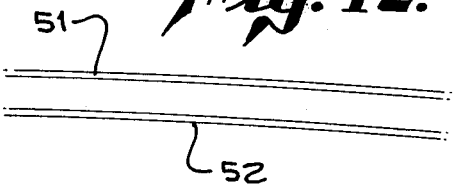
FIGS. 12 through 15 illustrate four types of recording means relative to the embodiment of FIGS. 10 and 11 corresponding to the recording means of FIGS. 6 through 9, respectively.
Figure 13:
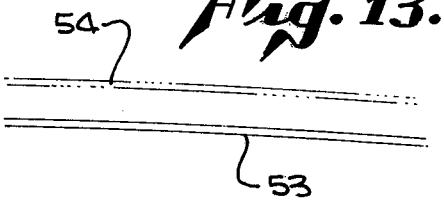
Figure 14:
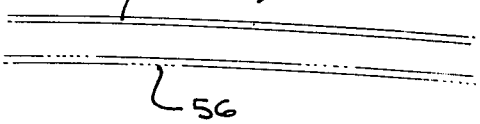
Figure 15:
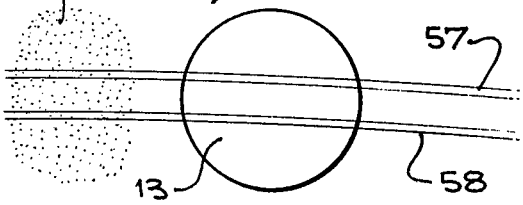

The discussion of the recording means of FIGS. 6 through 9 is applicable to the tracks 48, 49 of FIGS. 10 and 11. However, since only two indicating lines are made on mat 12, the distinctiveness of these two lines convey the information recorded as set forth in FIGS. 6 through 9. Thus, FIG. 12 is comparable to FIG. 6 and shows two distinct lines 51 and 52 from tracks 48, 49 recording a good swing (a white chalk stripe would be visible between lines 51 and 52). If the club face were slightly open, (thus indicating a slight slice) line 51 would be distinct and line 52 blurred. If the club face were slightly closed, line 52 would be distinct and line 51 blurred (indicating a slight hook). This will be made even clearer in the discussion of FIGS. 13 and 14. Thus, FIG. 13 is comparable to FIG. 7 and shows one distinct line 53 and a blurred line 54. This records an appreciable slice. FIG. 14 is comparable to FIG. 8 and shows one distinct line 55 and a blurred line 56 recording an appreciable hook. FIG. 15 is comparable to FIG. 9 and shows two distinct lines 57, 58 terminating abruptly in a blur 59 to record the golfer+s making of a divot. FIG. 15 also shows how to overall width of tracks 48, 49 is substantially less than the diameter of each surface 18. The same is true for the overall distance between pegs 25 and 26 and all the subsequent embodiments of dust displacing means. Further, means 46 is relatively light and does not appreciably affect the weight of the head 45. Thus, the weight of head 45, with or without means 46, is relatively the same as a conventionally rated golf club head.

Figure 16:
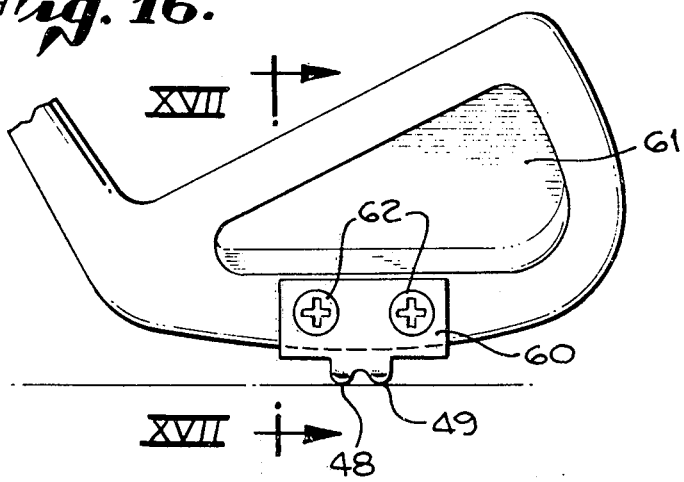
FIG. 16 is still another type of removable attachment means illustrated on a vertical view of a golf club head.
Figure 17:
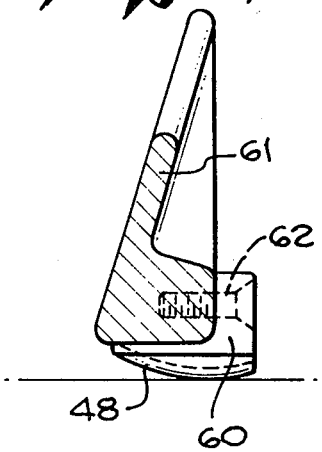
FIG. 17 is a partly sectional view taken along the lines XVII—XVII of FIG. 16.

Referring now to FIGS. 16 and 17, still another exemplary embodiment of dust displacing means is shown. This embodiment is similar to that of FIGS. 10 and 11 except that means 60 is secured to head 61 by countersunk screws 62 or the like. Tracks 48 and 49 are otherwise identical to the tracks of FIGS. 10 and 11 and no further discussion is deemed necessary.

Figure 19:
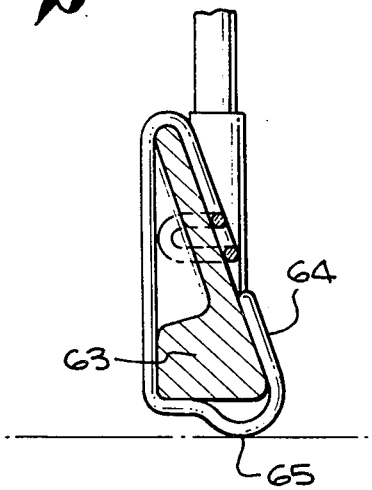
FIG. 19 is a view taken along the lines XIX—XIX of FIG. 18.
Figure 18:
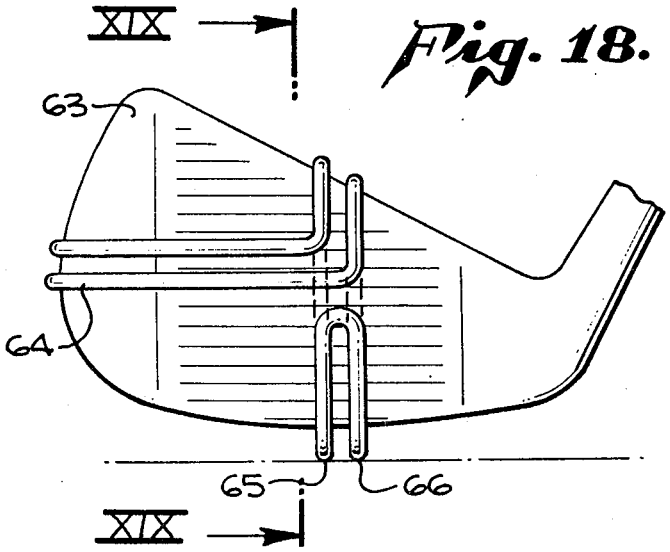
FIG. 18 is a vertical view of further attachment means for a golf club head.

FIGS. 18 and 19 show still another embodiment of a golf club head 63 having dust displacing means 64 in the form of a snap-on easily removable wire structure forming two downwardly extending tracks 65, 66. Again, the recording means made on mat 12 by tracks, 65, 66 are identical to the recording means of the embodiment of FIGS. 10 and 11.

Figure 20:
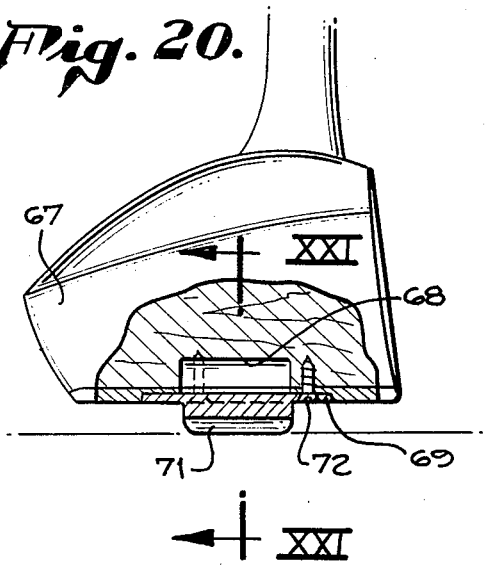
FIG. 20 is a vertical view of still another attachment means for the head of a wood golf club.
Figure 21:
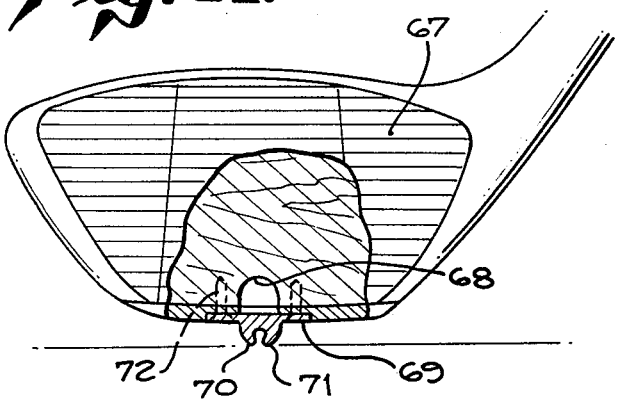
FIG. 21 is a view taken along the lines XXI—XXI of FIG. 20.
Figure 22:
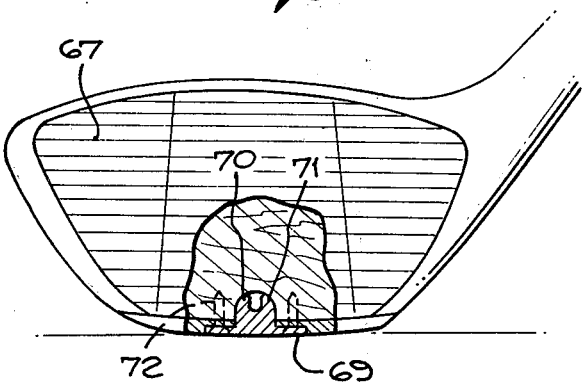
FIG. 22 is a vertical view, similar to FIG. 21, showing the attachment means in reversed, stored position on the golf club head.

FIGS. 20 and 21 illustrate still another embodiment and show a "wood" head 67 having a cavity 68 formed in its undersurface. The dust displacing means is in the form of a plate 69 having a pair of downwardly extending tracks 70, 71 removably secured to the undersurface of head 67 by countersunk screws 72 or the like. The weight of plate 69 is generally related to the weight of the material removed from head 67 to form cavity 68 so that the overall weight of head 67 is the same as that of a conventionally rated golf club. Further, as shown in FIG. 22, plate 69 may be inverted so that tracks 70, 71 enter cavity 68 and plate 69 is flush with the undersurface of club head 67 and secured therein by screws 72. Thus, club head 67 may be used conventionally with plate 69 and, by reversing plate 69, also as a training aid in accordance with my invention. The recording on mat 12 of tracks 70, 71 is similar to that of FIGS. 10 and 11.

The foregoing has described numerous embodiments for quickly and easily attaching dust displacing dust displacing means to a conventional or modified golf club head without appreciably effecting the weight of a conventionally rated golf club. The attachments comprising the displacing means are made of any suitable materials and relatively light in weight, such as light gage spring steel, wire, etc.

Such dust displacing means are used in conjunction with a preferably resilient mat having chalk dust or other soft, friable dust-like material spread over the surface. The displacing means records certain information on the mat which may be interpreted by the golfer to determine the efficiency of his swing. This information may be left on the mat to enable the golfer to compare his progress, then quickly and easily removed when desired.

Although certain prior art devices have suggested similar training aids to correct a golfer+s swing, none of them can record the depth and arc of the swing, the angle of the club face and the making of divots or the like.

Any suitable means, such as glue, Velcro, etc., may be used to permanently or semi-permanently attach the displacing means to the golf club heads. Screws, where indicated, are preferred so as to make the displacing means easily and quickly removed. Certain prior art training aids do leave recording marks on a surface; however, some are relatively expensive and complex, easily broken, not as durable and none can record all of the factors necessary for correcting a swing as in my invention.

Although modification of certain golf club heads have been suggested, it is to be understood that there is a trend today to vary the swing weight of a golf club by having changeable weights associated with the heads so that a player may change the weight in his own club. Thus, certain embodiments of my invention discloses displacing means which may be used in such golf club without varying the weight. Such displacing means may be hollow when manufactured and subsequently filled with a weighted material, such as lead, to result in the same overall weight as the removed weight.

In summary, when the mat 12 of my invention is struck with the golf club head at the correct arc angle and club face angle, the displacing means displace the chalk dust to the center and sides and two or three thin black lines are left on the mat showing a path through the center of the target with a slight insideout starting point. Thus, the golfer is shown not only what he has done right, but what he has done wrong.

This invention tells the golfer at a glance all of the three golf training factors heretofore described and shows a wrong pattern on one, two or three of these factors collectively or individually.

For instance, if a golfer has a correct vertical and horizontal arc angle, but has an open club face, the black lines will show those angles, but the lines will be blurred because the displacing means will not be going straight with the arc and will displace the chalk dust that would be left in the groove in the club face had been square.

The horizontal arc shows as an angle of the lines in relation to a straight line to the target.

The vertical arc or depth of swing, if too high, of course, leaves no mark and if too low shows up as a wavy line displaced in the center because of a wave created in the resilient mat and the displacing means will also sink into the mat deep enough to show a divot mark, indicated by the blurring of the lines.

The preferred resilent mat 12 may be used as a surface to drive regular golf balls off of at a driving range and will show the same angles etc. as when the mat is used for swing training only. The driver is the only club that contacts the ball after the bottom of the arc and by inserting the rubber tee in the aperture 16 in mat 12, a ball may be hit by the driver and the displacing means on the sole of this club will leave the indiscating marks on the right hand side of this rubber tee.

Permanent displacing means is undesirable since it would become abraded and scarred from the club hitting the ground and would therefore cut the marking surface when used for practice. One solution would be to have a removable cap that fits on the sole plate and covers permanently moulded displacing means against abrasion.

Clubs for swing training only, however, may be made with permanent displacing means of various configurations, but it is believed more desirable that golf swing practice should be with the club that is to be used in normal play. Thus, such displacing means should be removable.

Finally, although means displacing means leaving two and three indicating or recording marks on mat 12 have been disclosed, obviously displacing means leaving only a single mark or line or more than three lines or marks may be provided. However, a single line may be difficult to read to determine which side of the line is blurred or the like and more than three lines may be confusing.

I claim as my invention:

1. A method for analyzing both the depth and arc of swing of a golfer swinging a golf club head over a mat having indicia simulating golf ball thereon and analyzing the angle of the face of the golf club head when contacting said mat comprising the steps of:

dispersing a relatively thin film of relatively soft fine dry pulverized particles of material over the upper surface of said mat;

removably attaching dispersing means adapted to disperse said particles when contacting the same to form at least a pair of spaced paths of dispersed material to the head of said golf club, the overall weight of the club head before attaching the dispersing means thereto being only slightly less than the overall weight of the club head and dispersing means after attachment thereto;

swinging said golf club head over said indicia on said mat;

contacting said mat with said dispersing means thereby dispersing said particles into at least a pair of spaced elongated paths through said material dispersing the same in a pattern on all sides of said tracks;

analyzing the pattern of said dispersed particles to determine the depth of swing of said golfer from the overall length of said dispersed particles, analyzing the arc of swing of said golfer from the relationship between the linear configuration of said dispersed particles and the indicia on said mat, and analyzing the angle of the face of said golf club head when said dispersing means contacted said mat from the pattern of dispersion of said dispersed particles.

2. In the method of claim 1 wherein said step of removably attaching the dispersing means includes the step of attaching dispersing means including a pair of downwardly extending spaced tracks having their longitudinal axes extending in a direction generally normal to the plane of the face of said golf club head to said golf club head, the overall distance between the outside of said tracks being substantially less than the diameter of said indicia; and the step of analyzing the angle of the face of said golf club head includes the step of comparing the difference in distinctiveness of the pattern dispersed material on the side of the path of the material dispersed by one of said tracks with the distinctiveness of the pattern of the dispersed material on the side of the path of the material dispersed by the other of said tracks.

3. In the method of claim 1 wherein said step of removably attaching dispersing means includes the step of attaching three downwardly extending spaced elements, two of said elements being linearly aligned along an axis extending generally normal to the plane of the face of said golf club head and the third of said elements being spaced from said two of said elements and generally equidistant from each of said two of said elements, the overall distance between the outside of said two of said elements being substantially less than the diameter of said indicia; and the step of analyzing the angle of the face of said head includes the step of comparing the difference between the spacing of the pattern of the dispersed material on the side of the path of the material dispersed by one of said two of said tracks and said third track with the difference between the spacing of the pattern of the dispersed material on the side of the path of the material dispersed by the other of said two of said tracks and said third track.

4. In the method of claim 1 further including the step of analyzing the equivalence of said golfer making a divot by comparing the distinctiveness of the patterns of the dispersed material at the beginning of the swing arc with the distinctiveness of the patterns of the dispersed material at the bottom of terminal end thereof.

* * * * *